United States Patent [19]

Yoshida et al.

[11] 4,176,605

[45] Dec. 4, 1979

[54] LITHOGRAPHIC PRINTING PROCESS

[75] Inventors: Akihiko Yoshida, Tokyo; Akira Koaki, Mihara; Takahumi Nakano, Hiroshima; Mitsunao Miyake, Mihara; Teijiro Kanai; Izumi Misono, both of Tokyo, all of Japan

[73] Assignees: Toyo Ink Manufacturing Co., Ltd.; Mitsubishi Jukogyo Kabushiki Kaisha, both of Tokyo, Japan

[21] Appl. No.: 831,312

[22] Filed: Sep. 7, 1977

[30] Foreign Application Priority Data

Sep. 13, 1976 [JP] Japan ..... 51/108863
Sep. 13, 1976 [JP] Japan ..... 51/108864

[51] Int. Cl.[2] ..... B41L 25/14; B41L 25/02

[52] U.S. Cl. ..... 101/451; 101/148; 106/29; 106/30; 106/32; 252/346; 252/358

[58] Field of Search ..... 101/147, 148, 450, 451, 101/452; 252/346, 358; 106/28, 29, 30, 32

[56] References Cited

U.S. PATENT DOCUMENTS

| | | | |
|---|---|---|---|
| 1,354,639 | 10/1920 | Wood | 101/350 |
| 2,043,995 | 6/1936 | Goedike | 101/148 |
| 2,090,704 | 8/1937 | Rowell | 101/450 |
| 2,340,319 | 2/1944 | Goedike | 101/451 |
| 2,357,927 | 9/1944 | Berg | 106/28 |
| 2,396,415 | 3/1946 | Fischer | 106/29 |
| 2,450,534 | 10/1948 | Voet | 106/28 |
| 3,513,000 | 5/1970 | Vrancken | 101/452 |
| 3,666,502 | 5/1972 | Erikson | 106/32 |
| 3,803,070 | 4/1974 | Spencer et al. | 106/20 |
| 3,844,994 | 10/1974 | Vijayendran | 106/28 |
| 4,004,931 | 1/1977 | Lu | 106/30 |

FOREIGN PATENT DOCUMENTS

| | | | |
|---|---|---|---|
| 952260 | 8/1974 | Canada | 106/30 |
| 1611233 | 12/1972 | Fed. Rep. of Germany | 101/148 |
| 24237 | of 1908 | United Kingdom | 252/346 |

OTHER PUBLICATIONS

Droman, American Ink Maker, Apr. 1951, Plastisol Inks, pp. 31, 32, 33, 67.

*Primary Examiner*—Clyde I. Coughenour
*Attorney, Agent, or Firm*—Frank J. Jordan

[57] ABSTRACT

A lithographic printing process characterized by demulsifying an emulsion ink by the action of a cooling means and, if desired, a shearing force-giving means provided in a region of ink distributing rollers in an inking system.

10 Claims, 11 Drawing Figures

LITHOGRAPHIC PRINTING PROCESS

This invention relates to lithography comprising substantially wetting a plate with an emulsion ink without need of dampening water for the wetting and more particularly to a novel lithography comprising demulsifyiny an emulsion ink by the action of a cooling means and, if desired, a shearing force-giving means provided on ink distributing rollers in an inking system.

In an ordinary planography, printing is effected by contacting dampening water and an oily printing ink alternately with a plate consisting of oleophilic image areas and hydrophilic non-image areas since the ink is water-repellent or incompatible with water; however, in this case, it is difficult to balance the amount of dampening water fed and that of the ink fed thereby making it difficult to obtain high-quality printed matter reliably and greatly increasing the amount of spoilage at the time of start of printing.

Thus, there have heretofore been proposed various lithographic printing processes eliminating the necessity of dampening water. One of these proposed processes is so-called Dryography using a printing plate having a silicone rubber layer formed on the non-image areas thereof as disclosed in Japanese Patent Application Publication Gazettes Nos. 23042/1969 and 16044/1971, but this proposed process is commercially not put to practical use because the plate has low resistance to plate wear (short plate life). Another is a lithographic printing process using an emulsion printing ink as disclosed in Japanese Patent Application Publication Gazettes Nos. 26844/74, 27124/74 and 27125/74, but this proposed process raises various problems as to the fact that the quality of prints obtained is degraded particularly after printing for a long time, inks used are high in price and must be high in viscosity (since the use of low viscosity inks makes it almost impossible to effect printing), emulsion inks to be used are not so stable for their storage, and the like; among others, the high cost of the inks and the need of high viscosity thereof are vitally defective in applying said proposed process to printing newspaper.

In general, low-viscosity emulsion inks are excellent in stability and they will partly remain an emulsion after their transfer onto a plate since, at this point, they are not fully demulsified due to their too high stability. Because of this, they will hardly provide any practically satisfactory prints. On the other hand, high-viscosity emulsion inks are apt to be demulsified and will therefore be unstable during storage thereof in ink fountain therefor or at the initial stage of an inking system thereby not providing satisfactory prints either. In addition, as previously mentioned, the high-viscosity emulsion inks are high in price and therefore unsuitable for use for printing newspaper. In summary, to carry out lithographic printing with emulsion inks without causing commercial problems, it is required that the emulsion inks remain stable during their passage from an ink storage tank to ink distributing rollers for kneading them and that they be demulsified into an oleophilic ink component and an aqueous component at a plate when having been transferred to the plate. However, emulsion inks meeting such requirements were not developed before the accomplishment of this invention.

It has been found, as a result of our intensive studies, that in lithography using said emulsion inks which may be passed stable as far as a region of ink distributing rollers in an inking system, they will be demulsified extremely easily by the action of a cooling means and, if desired, a shearing force-giving means each provided on said ink distributing roller region, whereby they are demulsified or separated into an oleophilic ink component and an aqueous component and then transferred to a plate, resulting in providing high-quality prints reliably. Thus, this invention is based on this finding.

It has been revealed, as a result of studies of the present inventors, that emulsion inks depend for their stability on their viscosity and shearing rate as well as on their temperature.

The varnishes A, B and C as well as the other ingredients as shown in the following Table were mixed together to obtain an ink A. Further, as shown in the Table, there were obtained inks B, C and D containing the same ingredients as ink A, the inks A-D being different in solvent content from each other. Seventy parts by weight of each of the Inks so obtained and 30 parts by weight of ethylene glycol were emulsified by the use of a high speed mixer to prepare emulsion inks A, B, C and D which were then tested at 25° C. for stability, viscosity and shearing rate.

| Formulations of varnishes | |
|---|---|
| Varnish A | Parts by weight |
| NISSEKI NEOPOLYMER 120 (Trademark) (Maleic anhydride-modified petroleum resin prepared by Nippon Petrochemical Co., Ltd.) | 47 |
| Spindle oil | 53 |
| Gel varnish | Parts by weight |
| TAMANOL 356 (Trademark) (Rosin-modified phenol resin prepared by Arakawa Rinsan Co., Ltd.) | 32 |
| Linseed oil | 34 |
| Spindle oil | 30 |
| Aluminum stearate | 4 |
| Varnish C | Parts by weight |
| Gilsonite | 25 |
| Machine oil | 75 |
| Formulations of inks | |
| Ink A | Parts by weight |
| Varnish A | 20 |
| Gel varnish B | 11 |
| Varnish C | 8 |
| Carbon black for printing inks | 22 |
| Machine oil | 5 |
| Spindle oil | 32 |
| Ink B | Parts by weight |
| Ink A | 97 |
| Spindle oil | 3 |
| Ink C | Parts by weight |
| Ink A | 92 |
| Spindle oil | 8 |
| Ink D | Parts by weight |
| Ink A | 83 |
| Spindle oil | 17 |

Figure 1:
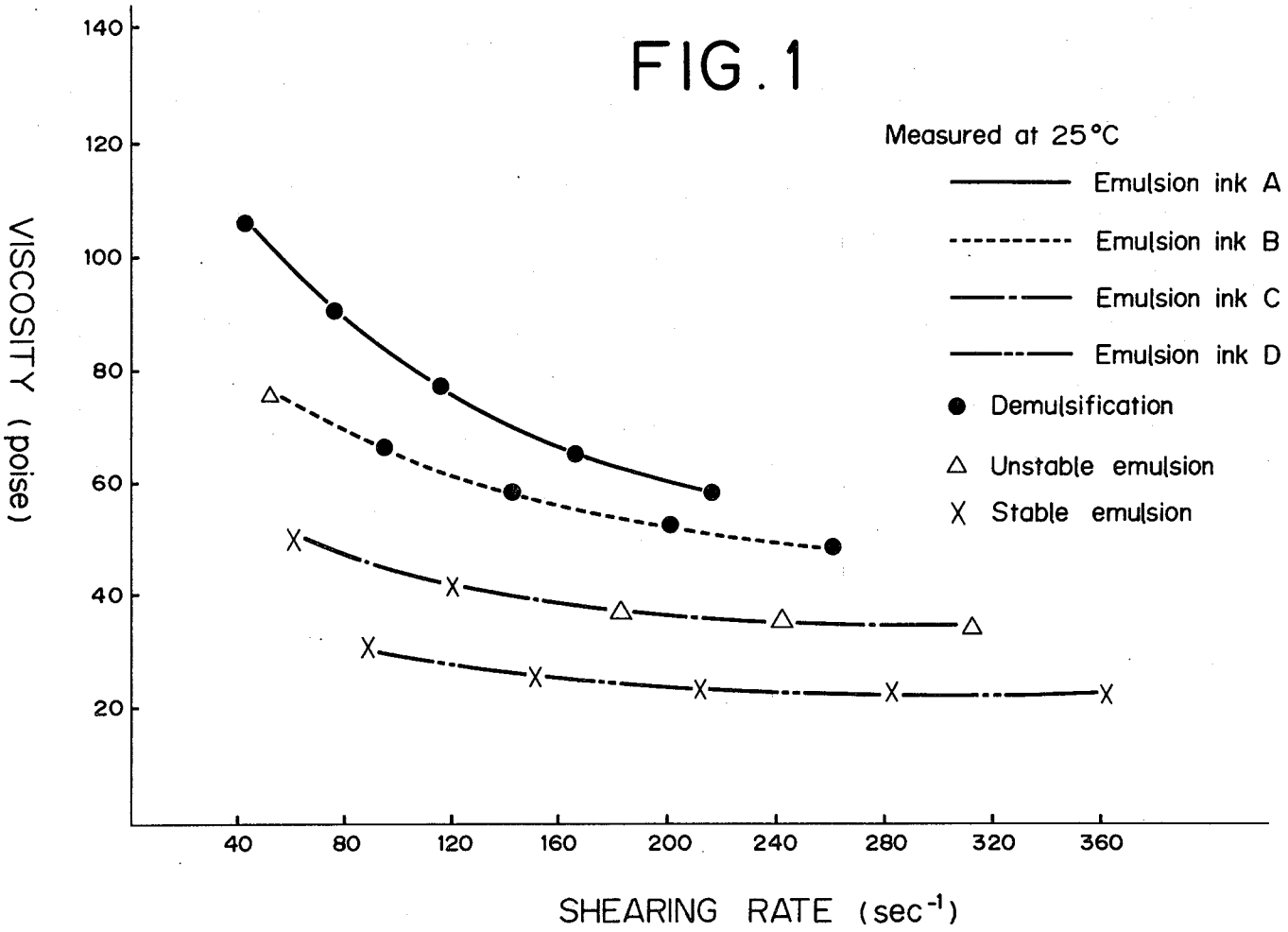
FIG. 1 shows graphs each indicating the relationship between the stability, viscosity and shearing rate of an emulsion ink.

The relationship between the stability, viscosity and shearing rate of each of the emulsion inks A, B, C and D, obtained from the results of the said tests is graphically shown in FIG. 1. From these relationships the demulsifying region, emulsion unstable region and emulsion stable region for the emulsion inks were determined, and these regions are shown in FIG. 2.

Figure 2:
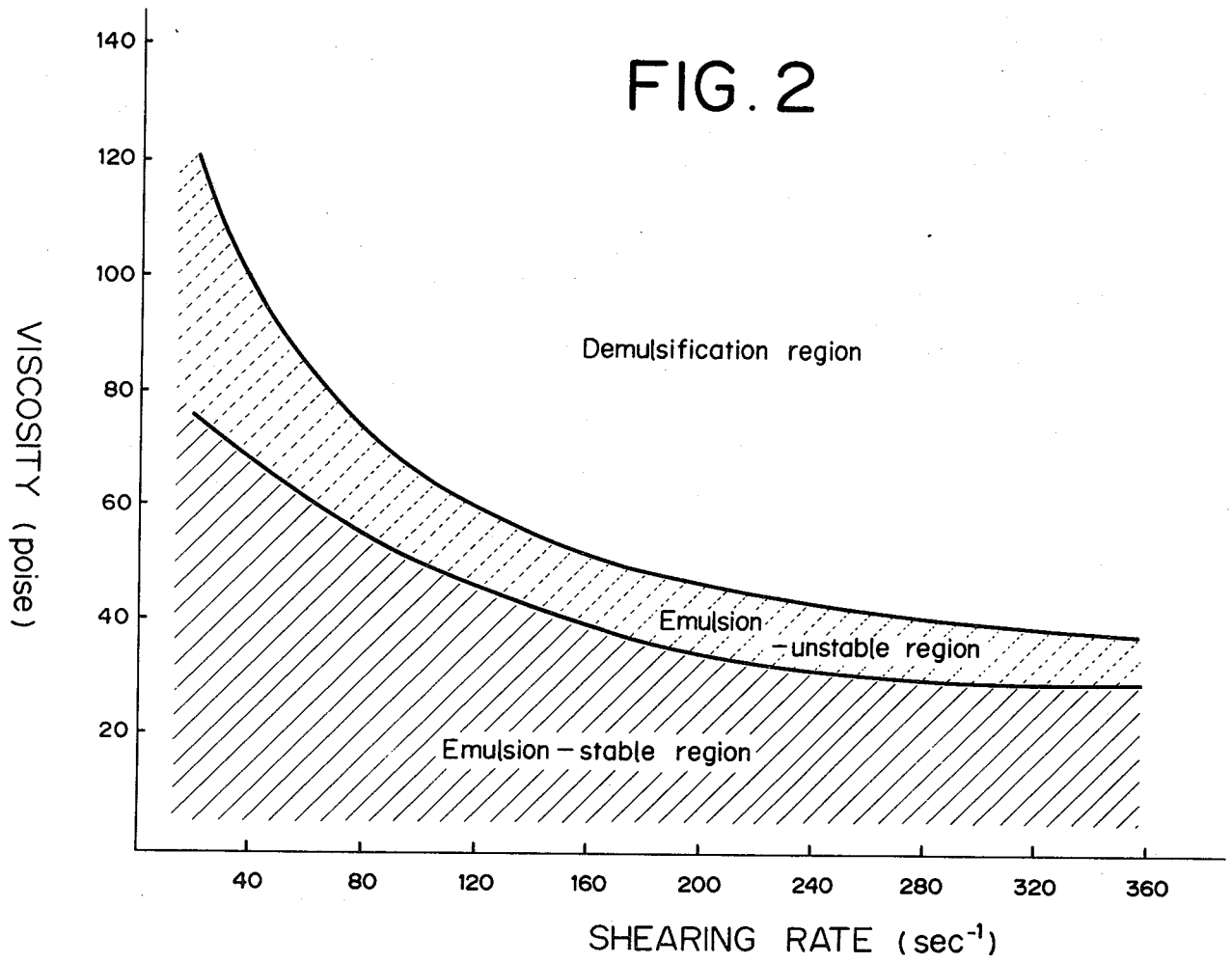
FIG. 2 shows the emulsion separation (demulsification), emulsions unstable and emulsion stable regions for the emulsion inks, which have been determined from the results indicated in FIG. 1.

As is seen from FIGS. 1 and 2, emulsion inks having a viscosity of not lower than 80 poise are unstable in remaining an emulsion and will be demulsified only if they are slightly increased in shearing rate, while emulsion inks having a viscosity of not higher than 40 poise are stable and will hardly be demulsified even if they are increased in shearing rate. In addition, emulsion inks having a viscosity of from more than 40 poise to less than 80 poise appear to be optionally controllable in stability as an emulsion depending on the shear rate given thereto; however, in reality, it is now impossible to effect commercially feasible printing with such inks since it is difficult to increase the shearing rate of the inks rapidly because of an insufficient capability of the apparatus and a delicate environmental change, for example, temperature at the time of printing.

Figure 3:
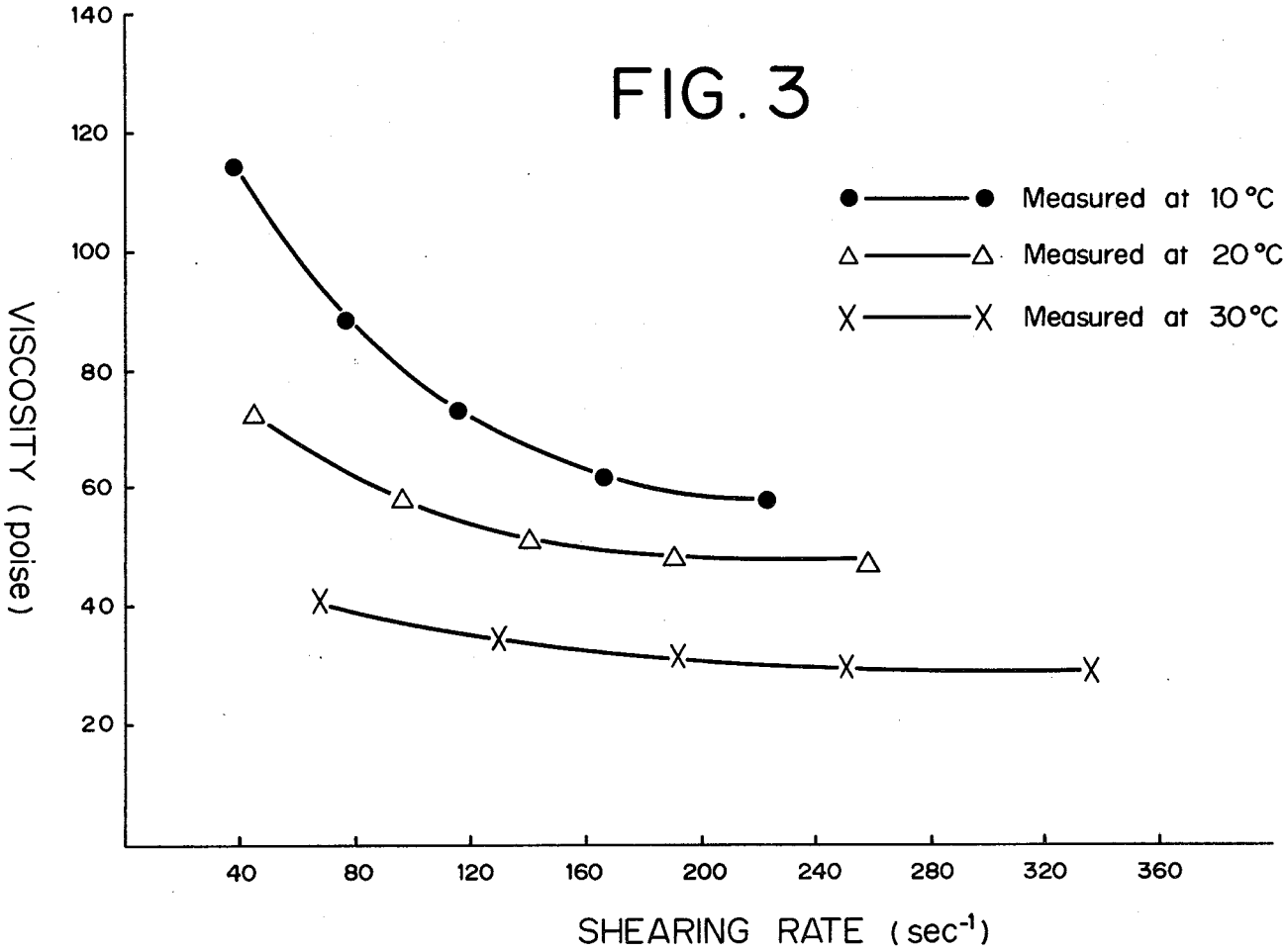
FIG. 3 shows the relationship between the viscosity and shearing rate of the emulsion ink C and the varying temperatures thereof.
Figure 4:
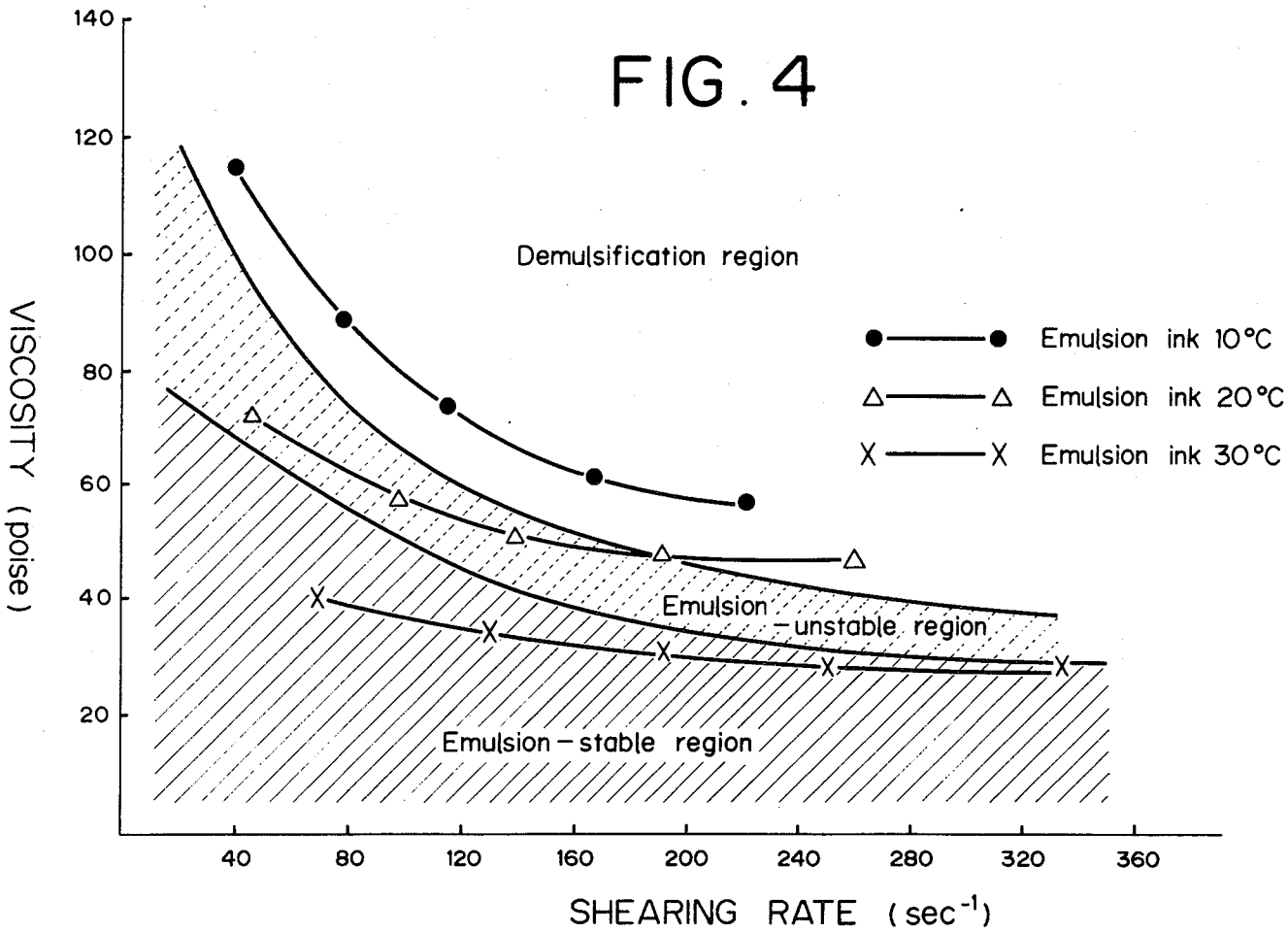
FIG. 4 shows the demulsifiable, unstable and stable regions as shown in FIG. 3.

The emulsion ink C which is stable as an emulsion ink at room temperatures, varies in viscosity and shearing rate with every change in temperature as is shown in FIG. 3. FIG. 4 is a figure prepared by superposing the graphs of FIG. 3 on FIG. 2.

As is seen from FIG. 4, the emulsion inks depend for their stability as an emulsion very greatly upon the temperature thereof. The emulsion inks which are very stable at 30° C. will be demulsified rapidly when being cooled to approximately 10° C., and they will easily be demulsified by increasing the shearing rate thereof when being cooled to approximately 20° C. This is considered to be the reason why satisfactory printing may be effected in accordance with this invention.

FIGS. 1 to 4 illustrate the properties of said specified emulsion inks, and such properties are common to those of emulsion inks of other types.

In the practice of the process of this invention, the process is conveniently operable since stable emulsion inks may be used therein, and they are perfectly demulsified after their passage through the cooling means and, if desired, shearing force-giving means whereby high-quality prints may be obtained reliably. In addition, the process is further industrially advantageous in that low-viscosity emulsion inks may be used therein thereby to provide such prints at a low cost and that the process may be applied to the printing of newspaper.

The lithography used in this invention includes all of those comprising passing an ink from an ink fountain, through ink distributing rollers and one or several form rollers, to a plate and typically includes known printing processes such as rotary press type, sheet printing type, direct lithographic type and offset lithographic type planographies.

Cooling by the cooling means used in this invention is effected, for example, by passing a cooling medium such as cold water or cold air through one or more hollow ink distributing rollers or by blowing cold air against one or more ink distributing rollers. It is particularly desirable that the cooling means be provided at a position near the form roller(s) in a region of ink distributing rollers.

By the cooling means, emulsion inks used herein are cooled to a temperature lower than ambient temperature, preferably to not higher than 20° C. and more preferably to a temperature between the freezing point of the emulsion ink and 15° C., thereby demulsifying the emulsion inks.

The aforementioned purpose and effect will not be attained only by such cooling as to prevent the ink on the distributing rollers from rising in temperature.

According to this invention, as is detailed later, the shearing force may be given by providing a roller which is rotated in contact with an ink distributing roller, at a peripheral velocity higher or lower than the ink distributing roller by at least 5% of the peripheral velocity thereof, by providing a roll, doctor or rod-like body in contact with the ink distributing roller or by differentiating the ink distributing rollers in contact with each other in peripheral velocity by at least 4%, preferably about 5–15%. In a conventional lithographic printing apparatus, the ink distributing rollers in contact with each other are differentiated in peripheral velocity by about 2–3%; however, this will not result in providing satisfactory prints reliably due to changes in printing environment, if the cooling temperature be considerably lowered.

In this invention, the location or position of the cooling means relative to that of the shearing force-giving means is not particularly limited, but it is desirable that the shearing force be exerted at the time of the cooling being effected.

Figure 5:
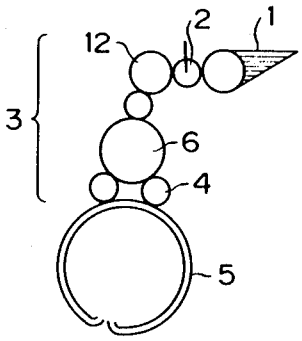
FIGS. 5–11 are each a view in section of a cooling means and shearing force-giving means embodying this invention.
Figure 9:
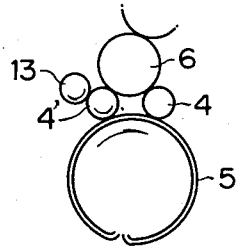

Referring to FIGS. 5 and 9, the cooling means according to this invention will be illustrated below.

Figure 6:
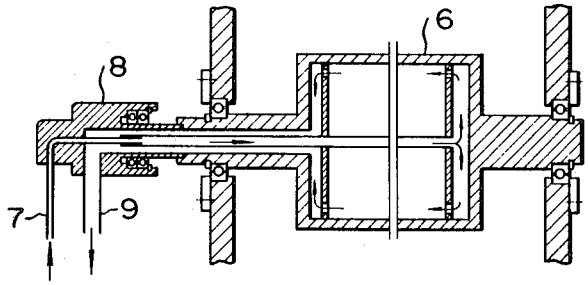
Figure 7:
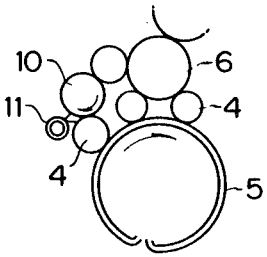
Figure 8:
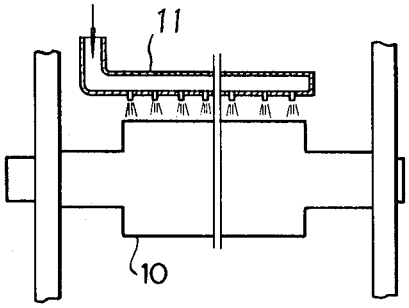

FIG. 5 indicates an ink feeding system of a lithographic press. An ink is fed from an ink fountain through an ink distributing roller region 3 wherein are included an ink roller 2, ink distributing rollers 6, 12 and form rollers 4, to a plate cylinder 5. As is shown in FIG. 6, the ink distributing roller 6 in the ink distributing roller region 3 may be designed to be cooled at the inside thereof by passing a cooling fluid through said inside. The cooling fluid is introduced into the ink distributing roller 6 at one end thereof through a conduit 7 and a rotary joint 8 and then discharged at the other end through the rotary joint 8 into a conduit 9, during which the heat of the roller 6 is removed. The cooling fluid from the roller 6 through the conduit 9 is cooled in the heat exchanger of a freezer (not shown) and then pumped into the roller 6 through the conduit 7. The temperature of the cooling fluid is regulated by the use of a thermostat. In addition to the cooling means as shown in FIG. 6, there is illustrated in FIGS. 7 and 8 another cooling means comprising introducing a cooled gas through a conduit 11 fitted near an ink distributing roller 10, to nozzles provided at the end portion of the conduit 11 of the ink distributing roller region 3, from which nozzles the cooled gas is ejected uniformly onto the surface of the roller 10 for cooling from the outside.

There is illustrated in FIG. 9 still another shearing force giving means comprising arranging a roller 13 having a smooth-faced and hydrophilic surface in contact with the first form roller 4' whereby an aqueous component produced by the demulsification of an emulsion ink fed is retained or held on the roller 13 and consequently the aqueous component does not fail to be transferred to the plate cylinder 5, thus obtaining high-quality prints reliably. The surface of the roller 13 may be one plated with chromium by a known technique, and such a plated surface is satisfactorily smooth-faced and hydrophilic.

Figure 10:
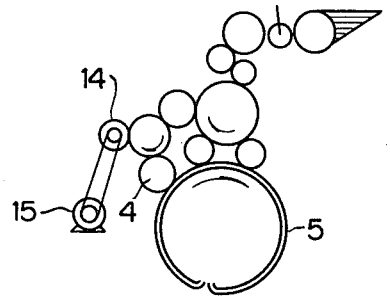
Figure 11:
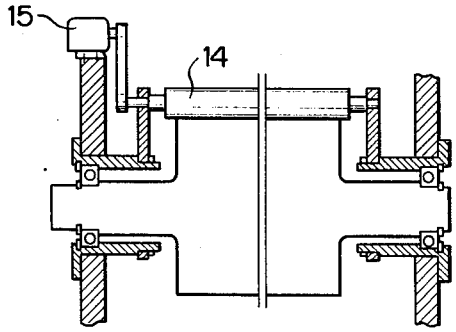

The shearing force-giving means used in this invention may comprise differentiating the ink distributing roller 6 from an ink distributing roller 12 in peripheral velocity by suitably selecting the number of teeth of a gear engaging both the roll 6 and the roll 12 and the diameter of each of these rollers. To this end, for example, the peripheral velocity of the ink distributing roller 6 is adjusted to be lower than that of the plate cylinder 5 by about 3% thereof, while the peripheral velocity of the ink distributing roller 12 is adjusted to be higher than that of the plate cylinder 5 by about 10% thereof. In addition to said shearing force-giving means, there is illustrated in FIGS. 10 and 11 another such means comprising providing a shearing force-giving roller 14 in contact with one of the ink distributing rollers and driving the roller 14 by a motor 15 to provide the ink with shearing force.

The emulsion inks used in this invention are such that they are passed as far as the cooling means while remaining a substantially stable emulsion and they are then demulsified or separated into an oleophilic component and an aqueous component after their passage through the cooling means. The oleophilic component consists essentially of a vegetable drying oil, synthetic resin varnish, natural resin varnish, high-boiling solvent, pigment and the like. The emulsion inks used herein are prepared by emulsifying 100 parts by weight of said oleophilic component and 10–100 parts by weight of an aqueous component containing alcohols, water and the like by the use of a known emulsifying technique. It is preferable that the thus-prepared emulsion inks at not higher than 15° C. have a kinetic elastic modulus of $10^2$–$10^3$ dyne/cm$^2$ at $10^{-1}$ rad/sec and $10^3$–$10^4$ dyne/cm$^2$ at $10^2$ rad/sec and that the inks at not lower than 20° C. have a kinetic elastic modulus of not higher than $10^2$ dyne/cm$^2$ at $10^{-1}$ rad/sec and not higher than $10^3$ dyne/cm$^2$ at $10^2$ rad/sec (the kinetic elastic moduli being measured by the use of a rheometer produced under the trademark of "Rheometer Almighty" by Iwamoto Works, Japan).

The emulsion inks are very stable at temperatures above ambient temperatures as previously mentioned and, in other words, the oleophilic and aqueous components may be easily emulsified. Therefore, it is also possible to make an emulsion ink in situ by feeding the oleophilic component and the aqueous component respectively in predetermined portions into an ink storage tank provided with a simple agitator.

This invention will be better understood by the following Examples wherein all parts are by weight unless otherwise specified.

EXAMPLE 1

The following ingredients including the aforesaid varnish A, gel varnish B and varnish C, were mixed together to form an ink composition.

| | |
|---|---|
| Varnish A | 18 Parts |
| Gel varnish B | 10 " |
| Varnish C | 7 " |
| Carbon black for printing inks | 20 " |
| Linseed oil | 5 " |
| Spindle oil | 40 " |

Seventy parts of the ink composition so formed and 30 parts of ethylene glycol were dispersed in each other by the use of a high speed mixer thereby to obtain a W/O emulsion ink which had at 30° C. a kinetic elastic modulus of about 15 dyne/cm$^2$ at $10^{-1}$ rad/sec and about 480 dyne/cm$^2$ at $10^2$ rad/sec.

The emulsion ink so obtained may be used for printing in lithographic printing apparatus including a cooling means (as shown in FIG. 6) in which water is passed at 10° C., to permit the apparatus to operate conveniently and efficiently without supply of water from the outside, thus obtaining high-quality prints. In this printing, the temperature of the ink was about 40° C. before passage through the cooling means and about 12°–14° C. after passage therethrough.

COMPARATIVE EXAMPLE 1

The procedure of Example 1 was followed except city water at about 22° C. was substituted for the cooling water at 10° C., with the result that low-quality prints with incidental stain was obtained. In this case, the temperature of the ink was about 27°–30° C. after passage through the ink distributing roller in which the city water was passed.

EXAMPLE 2

| | |
|---|---|
| PETROSIN 130 (Trademark) (Petroleum resin produced by Mitsui Petrochemical Co., Ltd.) | 50 Parts |
| Spindle oil | 50 Parts |

The above ingredients were mixed together to form a mixture which was heated to 100° C. for 1.5 hours for dissolution, thereby to obtain a varnish D.

The following ingredients including the varnish D so obtained were mixed together to produce an ink composition.

| | |
|---|---|
| Varnish D | 20 Parts |
| Gel varnish B | 7 " |
| Varnish C | 7 " |
| Carbon black for printing inks | 20 " |
| Linseed oil | 5 " |
| Spindle oil | 30 " |
| Machine oil | 11 " |

Sixty parts (60) of the ink composition so produced, 10 parts of glycerine and 30 parts of water were mixed together for uniform dispersion thereof by the use of a high speed mixer thereby to obtain a W/O emulsion ink. The thus-obtained W/O emulsion ink at 30° C. had a kinematic elastic modulus of about 23 dyne/cm$^2$ at $10^{-1}$ rad/sec and about 340 dyne/cm$^2$ at $10^2$ rad/sec.

The procedure of Example 1 was followed to effect printing with this emulsion ink with the result that the printing apparatus was operated conveniently and efficiently without supply of water from the outside thus obtaining high-quality prints.

EXAMPLE 3

The following ingredients including the varnish A and varnish C were mixed together to produce an ink composition.

| | | |
|---|---|---|
| Varnish A | 16 | Parts |
| Varnish C | 10 | " |
| Carbon black for printing inks | 18 | " |
| Polymerized linseed oil (15 poise at 25° C.) | 4 | " |
| Machine oil | 30 | " |
| Spindle oil | 20 | " |
| Prussian blue (pigment) | 2 | " |

Fifty-five (55) parts of the ink composition so produced and 45 parts of ethylene glycol were dispersed in each other by the use of a high speed mixer to obtain a W/O emulsion ink having, at 30° C., a kinetic elastic modulus of about 8 dyne/cm$^2$ at $10^{-1}$ rad/sec and about 230 dyne/cm$^2$ at $10^2$ rad/sec.

The emulsion ink so obtained was used for printing in the same manner as in Example 1 with the result that the printing apparatus was operated with the ink conveniently and efficiently without supply of water from the outside thereby to obtain high-quality prints.

EXAMPLE 4

Seventy (70) parts of the same ink composition as produced in Example 2, 8 parts of glycerine and 22 parts of water were mixed together for uniform dispersion thereof by the use of a high speed mixer, thus obtaining a W/O emulsion ink having, at 30° C., a kinetic elastic modulus of about 23 dyne/cm$^2$ at $10^{-1}$ rad/sec and about 340 dyne/cm$^2$ at $10^2$ rad/sec.

The emulsion ink so obtained may be used for printing in a planographic printing apparatus including a cooling means (as shown in FIG. 6) wherein water is passed at 10° C. and a shearing force-giving means (as shown in FIG. 5) wherein the peripheral velocity of the ink distributing roller 6 is adjusted to be lower than that of the plate cylinder 5 by 3% thereof while that of the ink distributing roll 12 adjusted to be higher than that of the plate cylinder 5 by 10% thereof, thereby to permit the printing apparatus to operate conveniently and efficiently without supply of water from the outside, thus obtaining further high-quality prints.

EXAMPLE 5

The following ingredients including the varnish A and varnish C, were mixed together to produce an ink composition.

| | | |
|---|---|---|
| Varnish A | 14 | Parts |
| Varnish C | 10 | " |
| Carbon black for printing inks | 18 | " |
| Polymerized linseed oil (15 poise at 25° C.) | 4 | " |
| Machine oil | 30 | " |
| Spindle oil | 22 | " |
| Prussian blue (pigment) | 2 | " |

Sixty-five (65) parts of the ink composition so produced and 35 parts of ethylene glycol were dispersed in each other by the use of a high speed mixer thereby to obtain a W/O emulsion ink having, at 30° C., a kinematic elastic modulus of about 7 dyne/cm$^2$ at $10^{-1}$ rad/sec and about 210 dyne/cm$^2$ at $10^2$ rad/sec.

The emulsion ink so obtained was used for printing in the same manner as in Example 4 with the result that the printing apparatus was operated conveniently and efficiently without supply of water from the outside thereby to obtain further high-quality prints.

EXAMPLE 6

The procedure of Example 4 was followed except that a device as shown in FIG. 10 was provided as the shearing force-giving means to adjust the peripheral velocity of a roller 14 to be 3% lower than that of an ink distributing roller in contact with the roller 14, the 3% being based on the peripheral velocity of the ink distributing roller. Thus, the printing apparatus was operated with the ink conveniently and efficiently thereby obtaining further high-quality prints.

What is claimed is:

1. In a lithographic printing process, a method of providing an aqueous component to a printing plate comprising the steps of:
   - supplying in an ink fountain an emulsion ink which is stable at ambient temperature but subject to demulsification upon cooling,
   - Passing said stable emulsion ink to a region of rollers in an inking system,
   - said emulsion ink being in stable condition in said ink fountain and while passing to said region,
   - cooling said emulsion ink at said region,
   - demulsifying said emulsion into an oleophilic component and aqueous component at said region, said demulsifying being effected by said action of said cooling, and
   - passing said oleophilic and aqueous components so produced to a printing plate in the inking system to thereby obtain high-quality prints reliably without the need of dampening water.

2. A lithographic printing process comprising the steps of:
   - supplying a stable emulsion ink in an ink fountain,
   - supplying in an ink fountain an emulsion ink which is stable at ambient temperature but subject to demulsification upon cooling,
   - demulsifying said emulsion into an oleophilic component and an aqueous component at said region, said demulsifying being effected by said action of said cooling, and
   - passing said oleophilic and aqueous components so produced to a printing plate in the inking system to thereby obtain highgrowth prints reliably without the need of dampening water.

3. A lithographic printing process according to claim 2, wherein the cooling step comprises passing a cooling medium through the inside of at least one ink distributing roller.

4. A lithographic printing process according to claim 3, wherein the cooling step comprises lowering the temperature of the emulsion ink to 20° C. or below for demulsification.

5. A lithographic printing process according to claim 2, wherein the cooling step comprises blowing a cooling medium uniformly against at least one ink distributing roller.

6. A lithographic printing process according to claim 5, wherein the cooling step comprises lowering the temperature of the emulsion ink to 20° C. or below for demulsification.

7. A lithographic printing process according to claim 2, wherein the emulsion ink has, at not higher than 15° C., a kinematic elastic modulus of $10^2$–$10^3$ dyne/cm$^2$ at $10^{-1}$ rad/sec and $10^3$–$10^4$ dyne/cm$^2$ at $10^2$ rad/sec and has, at not lower than 20° C., a kinetic elastic modulus of not higher than $10^2$ dyne/cm$^2$ at $10^{-1}$ rad/sec and not higher than $10^3$ dyne/cm$^2$ at $10^2$ rad/sec.

8. A lithographic printing process comprising the steps of:

supplying in an ink fountain an emulsion ink which is stable at ambient temperature but subject to demulsification upon cooling, passing said emulsion ink to a region of rollers in an inking system, cooling said stable emulsion ink at said region, demulsifying said emulsion into an oleophilic component and an aqueous component at said region, said demulsifying being effected by said action of said cooling, effecting a shearing, force-giving action at said region, and passing said oleophilic and aqueous components so produced to a printing plate in the inking system to thereby obtain high-quality prints reliably without the need of the dampening water.

9. A lithographic printing process according to claim 8, wherein the cooling step comprises passing a cooling medium through the inside of at least one ink distributing roller, and effecting force-giving action comprises providing a roller in contact with one of the ink distributing rollers and differentiating said two contacting rollers from each other in peripheral velocity by at least 4%.

10. A lithographic printing process according to claim 11, wherein the emulsion ink has, at not higher than 15° C., a kinematic elastic modulus of $10^2$–$10^3$ dyne/cm$^2$ at $10^{-1}$ rad/sec and $10^3$–$10^4$ dyne/cm$^2$ at $10^2$ rad/sec and has, at not lower than 20° C., a kinematic elastic modulus of not higher than $10^2$ dyne/cm$^2$ at $10^{-1}$ rad/sec and not higher than $10^3$ dyne/cm$^2$ at $10^2$ rad/sec.

* * * * *